US006827326B2

(12) United States Patent
Giri

(10) Patent No.: US 6,827,326 B2
(45) Date of Patent: Dec. 7, 2004

(54) MODULAR FORMING SYSTEM FOR BOX CULVERT

(75) Inventor: Kiran P. Giri, Leawood, KS (US)

(73) Assignee: GCI Pipe Products, Inc., Shawnee, KS (US)

( * ) Notice: Subject to any disclaimer, the term of this patent is extended or adjusted under 35 U.S.C. 154(b) by 261 days.

(21) Appl. No.: 10/279,255

(22) Filed: Oct. 23, 2002

(65) Prior Publication Data

US 2004/0079861 A1 Apr. 29, 2004

(51) Int. Cl.[7] ..... B28D 17/00

(52) U.S. Cl. ..... 249/165; 249/163; 249/168; 425/195

(58) Field of Search ..... 249/63, 142, 156, 249/163, 165, 168; 425/195

(56) References Cited

U.S. PATENT DOCUMENTS

| | | | | |
|---|---|---|---|---|
| 2,961,731 A | | 11/1960 | Buzzell et al. | |
| 4,123,034 A | * | 10/1978 | Crunk et al. | 249/156 |
| 4,219,513 A | | 8/1980 | Miller | |
| 4,300,746 A | * | 11/1981 | Schoen | 249/13 |
| 4,494,724 A | * | 1/1985 | Rex | 249/148 |
| 4,969,626 A | | 11/1990 | Strauch | |
| 5,076,536 A | | 12/1991 | Fitzgerald | |
| 5,286,440 A | * | 2/1994 | Beacom | 264/333 |
| 5,301,918 A | | 4/1994 | Miller | |
| 5,651,913 A | | 7/1997 | Lee | |
| 6,164,618 A | | 12/2000 | Yonemura | |

* cited by examiner

*Primary Examiner*—James P. Mackey
*Assistant Examiner*—Donald Heckenberg
(74) *Attorney, Agent, or Firm*—Hovey Williams LLP

(57) ABSTRACT

A modular forming system (10) configured for forming concrete box culverts ($C_1$) and ($C_2$) is disclosed. The inventive forming system enables a strong and secure system that is relatively easier and more efficient to assemble. The system (10) broadly includes a pallet (12), a core (14), a jacket (16), and a header (18). The pallet (12) is operable to mold the ribbed face ($F_2$) of the culverts. The core (14) is encircled by the pallet (12) and is operable to mold the inner circumferential surface (ICS) of the culverts. The jacket (16) is supported on the pallet (12) and is operable to mold the outside circumferential surface (OCS) of the culverts. The header (18) encircles the core (14) and is operable to slide between the core (14) and the jacket (16) to mold the non-ribbed face ($F_1$) of the culverts. The pallet (12) and header (18) have a modular configuration, including a plurality of segments that when properly positioned end-to-end, define pallet keyways (76) and header keyways (162), respectively, for receiving keys (82) to removably and securely couple the adjacent segments together.

45 Claims, 5 Drawing Sheets

MODULAR FORMING SYSTEM FOR BOX CULVERT

BACKGROUND OF THE INVENTION

1. Field of the Invention

The present invention relates generally to systems for forming concrete. More specifically, the present invention concerns a modular forming system for box culverts that utilizes a modular header and a modular pallet each including segmented members formed from a cast material and interconnected with a plurality of keys. The inventive configuration provides a forming system that is stronger, more durable, and more efficiently assembled than existing forming systems.

2. Discussion of Prior Art

Those ordinarily skilled in the construction industry will appreciate that precast concrete box culverts are a desired solution over cast-in-place culverts for a wide variety of applications such as highway bridges and drainage conditions, such as storm and sanitary sewers. These precast culverts come in a variety of sizes (e.g., various rises, spans, thicknesses, etc.) and can be joined together at the ends (e.g., with mastic, gaskets, etc.) to form the desired run.

Forming systems for forming the pre-cast concrete box culverts are known in the art. These prior art forming systems typically include adjustable cores, jackets, and pallets. The adjustable cores, jackets, and pallets include segments formed from fabricated sheet steel that are bolted together to form the desired sized form. These prior art forming systems further include a non-adjustable header ring fabricated from sheet steel and an adjustable dead weight header frame for pressing the header ring down between the core and the jacket.

These prior art forming systems are problematic and subject to several limitations. For example, the assembly of the prior art systems is very labor-intensive, requiring two workers as long as a day and a half to assemble the multitude of necessary bolts. Additionally, during vibration of the forms, the bolts are undesirably prone to becoming loose and thereby compromising the mold. Furthermore, in order to change the size of culvert being formed, a separate header ring is required and thus must either be manufactured, or inventoried and the header frame must further be adjusted to cooperate with the separate ring. These problems and limitations are undesirable in that they add increased labor and/or expense to assembling the forming systems. In addition, such sheet steel components, and in particular the header components, make a limited contribution to densification of the concrete.

SUMMARY OF THE INVENTION

The present invention provides an improved modular forming system for box culverts that does not suffer from the problems and limitations of the prior art forming systems detailed above. The inventive forming system enables a strong and secure system that is relatively easier and more efficient to assemble.

A first aspect of the present invention concerns a header for use with a pallet, a jacket supported on the pallet, and a core encircled by the jacket to define a form for forming concrete received therebetween into box culverts having opposite faces. The header broadly includes a plurality of members removably couplable to one another so that when the members are coupled together they are operable to encircle the core and slide between the core and the jacket to contact concrete received therebetween to form one of the faces of the box culvert, and a key. Each member includes at least one channel defined therein being sized and dimensioned to cooperate with the channel in an adjacent member to define a keyway. The key is sized and dimensioned to be slidably received in the keyway to thereby removably couple the adjacent members.

A second aspect of the present invention concerns a pallet for use with a core, a jacket encircling the core, and a header slidable between the core and the jacket to define a form for forming concrete received therebetween into box culverts having opposite faces. The pallet broadly includes a plurality of members removably couplable to one another so that when the members are coupled together they are operable to encircle the core and support the jacket to contact concrete received therebetween to form one of the faces of the box culvert, and a key. Each member includes at least one channel defined therein being sized and dimensioned to cooperate with the channel in an adjacent member to define a keyway. The key is sized and dimensioned to be slidably received in the keyway to thereby removably couple the adjacent members.

A third aspect of the present invention concerns a key for removably coupling at least two segments of a segmented casting form wherein each segment includes at least one channel defined therein being sized and dimensioned to cooperate with the channel of an adjacent segment to define a keyway. The key broadly includes a pair of spaced apart ridge sections, a transverse section spanning the space between the ridge sections and thereby joining the ridge sections together, and a locking mechanism to selectively prevent removal of each of the ridge sections from the respective channel when the key is received in the keyway. Each ridge section is sized and dimensioned to be slidably received in one of the channels. The transverse section is sized and dimensioned so that when one of the ridge sections is received in one of the channels of one of the segments and the other ridge section is received in the channel of the adjacent segment, the segments are generally in a sealing relationship with one another.

A fourth aspect of the present invention concerns a modular forming system for forming concrete into a box culvert having opposite faces. The system broadly includes a core operable to mold the inside circumferential surface of the culvert, a pallet encircling the core and being operable to mold one of the faces of the culvert, a jacket supported on the pallet and spaced from the core and being operable to mold the outside circumferential surface of the culvert, a header encircling the core and being operable to slide between the core and the jacket and being operable to mold the other face of the culvert, and a plurality of keys. The pallet includes a plurality of pallet members removably couplable to one another so that when the pallet members are coupled together they are operable to encircle the core to contact concrete received therebetween to form the one of the faces of the box culvert. Each pallet member includes at least one pallet channel defined therein being sized and dimensioned to cooperate with the pallet channel in an adjacent pallet member to define a pallet keyway. The header includes a plurality of header members removably couplable to one another so that when the header members are coupled together they are operable to encircle the core and slide between the core and the jacket to contact concrete received therebetween to form the other face of the box culvert. Each header member includes at least one header channel defined therein being sized and dimensioned to cooperate with the header channel in an adjacent header member to define a header keyway. Each key is sized and dimensioned to be slidably received in the pallet and header keyways to thereby removably couple the respective adjacent members.

In a preferred embodiment of the forming system, adjacent members include complementing alignment pins and pin-receiving apertures that provide quick alignment of the members to present the keyways for quick interconnection of the adjacent members with the keys. In the preferred embodiment, when adjacent members are properly aligned, the keyways formed therein are oriented such that the keys can be easily slidably received therein to provide a secure interconnection, however, the keyways resist accumulation of concrete therein. The preferred embodiment further includes a mechanism for quickly and easily removing the keys from the keyways for disassembly of the forming system.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 1:
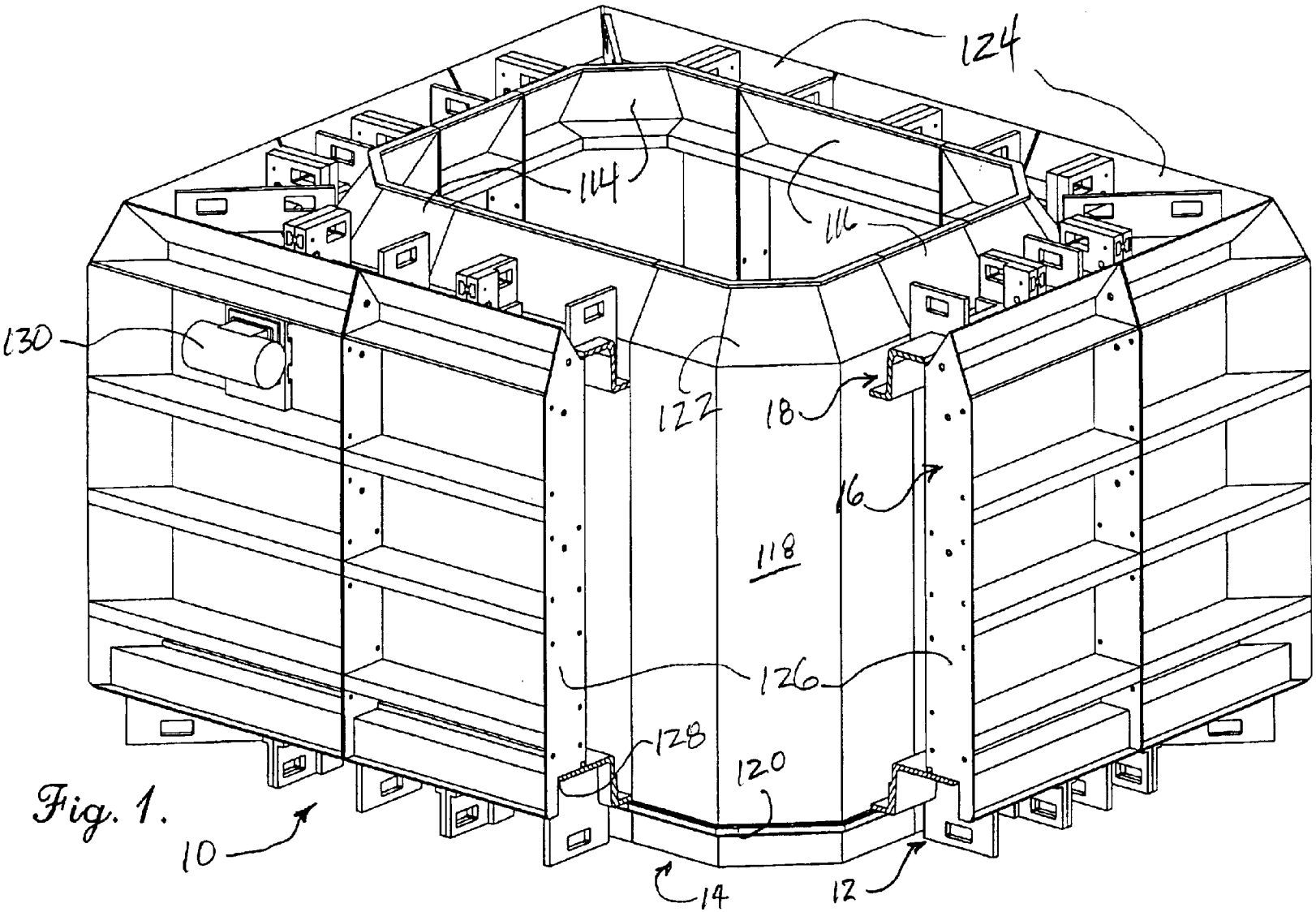
FIG. 1 is a perspective view of a forming system constructed in accordance with a preferred embodiment of the present invention with portions of the header, the jacket, and the pallet removed to illustrate features of those components and the core.
Figure 10:
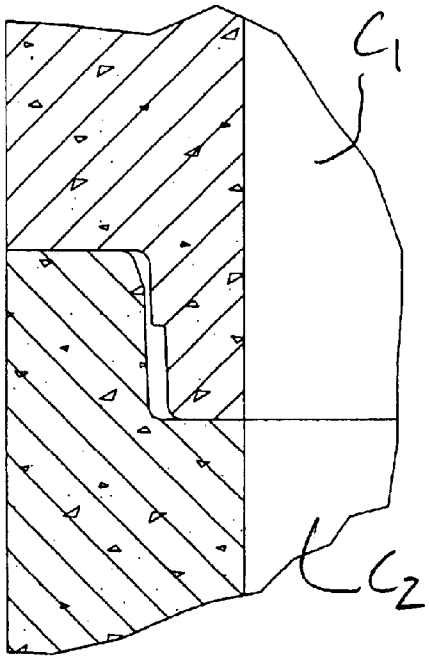
FIG. 10 is an enlarged fragmentary view of the culverts illustrated in FIG. 9 particularly showing the chamfered ends formed by the header and pallet of the illustrated system and configured for receiving a sealer.
Figure 9:
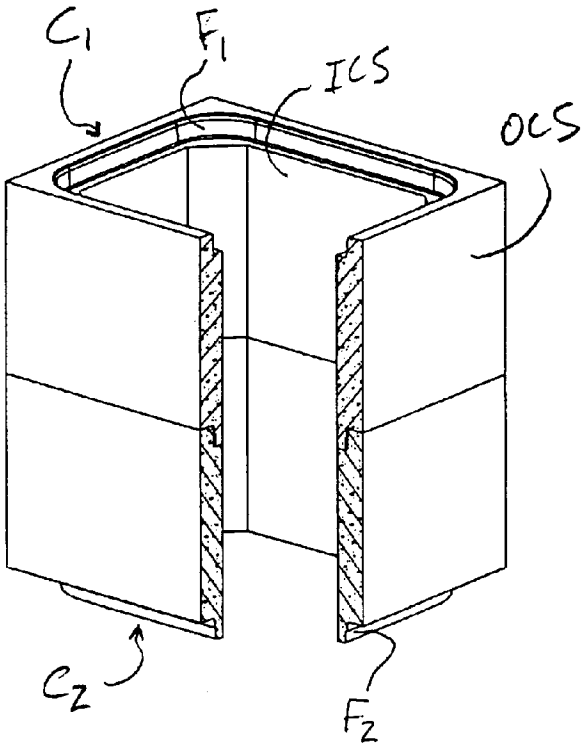
FIG. 9 is a pair of exemplary box culverts formed in the system illustrated in FIG. 1 and joined at the ends with a portion of the culverts removed.
Figure 8:
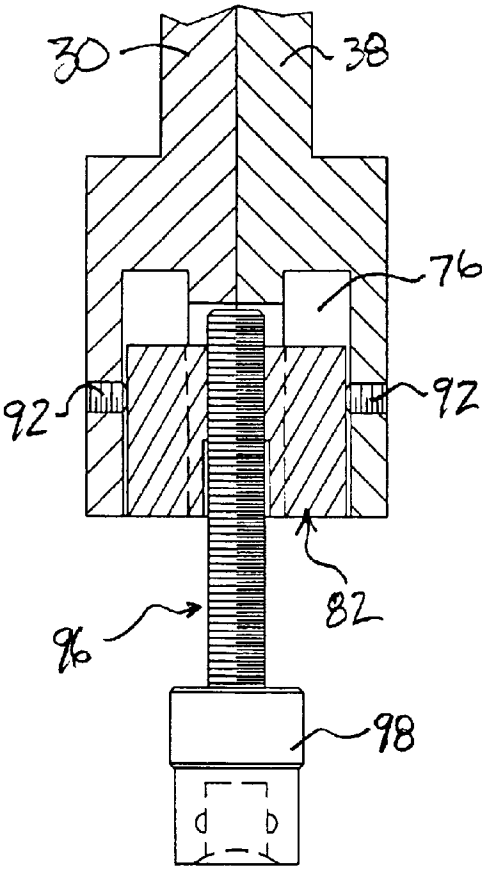
FIG. 8 is an enlarged sectional view of the key and keyway taken substantially along line 8—8 of FIG. 7 and shown with a removal shank partially threaded into the key.

FIG. 1 illustrates a modular forming system 10 constructed in accordance with a preferred embodiment of the present invention and configured for forming concrete box culverts $C_1$ and $C_2$ (see FIGS. 9 and 10). Although the principles of the present invention are particularly well suited for forming systems used to form concrete box culverts, the principles of the present invention are equally applicable to virtually any modular forming system that utilizes a secure coupling of the components in a manner that enables labor-efficient assembly. The illustrated system 10 broadly includes a pallet 12, a core 14, a jacket 16, and a header 18.

Referring briefly to FIGS. 9 and 10, the culverts $C_1$ and $C_2$ are exemplary concrete box culverts formed in the illustrated system 10. It will be appreciated that the illustrated culverts $C_1$ and $C_2$ are virtually identical in construction, therefore, only the culvert $C_1$ will be described in detail with the understanding that the culvert $C_2$ is similarly configured. The culvert $C_1$ defines an outside circumferential surface OCS and an inside circumferential surface ICS separated by a thickness T of concrete. The culvert $C_1$ further defines a face $F_1$ and an opposite face $F_2$ (shown on the culvert $C_2$). As shown in FIG. 10, the faces $F_1$ and $F_2$ are generally L-shaped and complementally configured so that the face $F_1$ cooperates with the face $F_2$ of an adjacent culvert (e.g., the culvert $C_2$) to join the culverts together. The face $F_2$ is ribbed, however, the face $F_1$ is non-ribbed (see FIG. 10). In this manner, when a pair of culverts are joined together, a sealer (e.g., a gasket, mastic, etc.) can be inserted between the complemental faces to facilitate a generally liquid-tight seal therebetween. In this regard, the edges of the faces $F_1$ and $F_2$ are preferably chamfered to facilitate inserting the sealer (e.g., minimizing tearing, deforming, etc.).

Returning to FIG. 1, in the illustrated system 10, the pallet 12 is operable to mold one of the faces of a concrete box culvert (e.g., the ribbed face $F_2$ of the culvert $C_2$). The core 14 is encircled by the pallet 12 and is operable to mold the inner circumferential surface of the box culvert (e.g., the surface ICS of the culvert $C_1$). The jacket 16 is supported on the pallet 12 and is operable to mold the outside circumferential surface of the box culvert (e.g., the surface OCS of the culvert C,). The header 18 encircles the core 14 and is operable to slide between the core 14 and the jacket 16 to mold the other face of the box culvert (e.g., the non-ribbed face $F_1$ of the culvert $C_1$).

In more detail, and as shown in FIGS. 4–8, the illustrated pallet 12 is modular and includes a plurality of pallet span segments 20, 22, 24, and 26, a plurality of pallet rise segments 28, 30, 32, and 34, and a plurality of pallet corner segments 36, 38, 40, and 42. As will be subsequently described in detail, each of the segments presents a similar forming surface and is removably and securely couplable to two adjacent segments. In this manner, the segments cooperate to define the enclosed pallet 12 operable to mold the ribbed face $F_2$ of the culverts $C_1$ and $C_2$.

Figure 5:
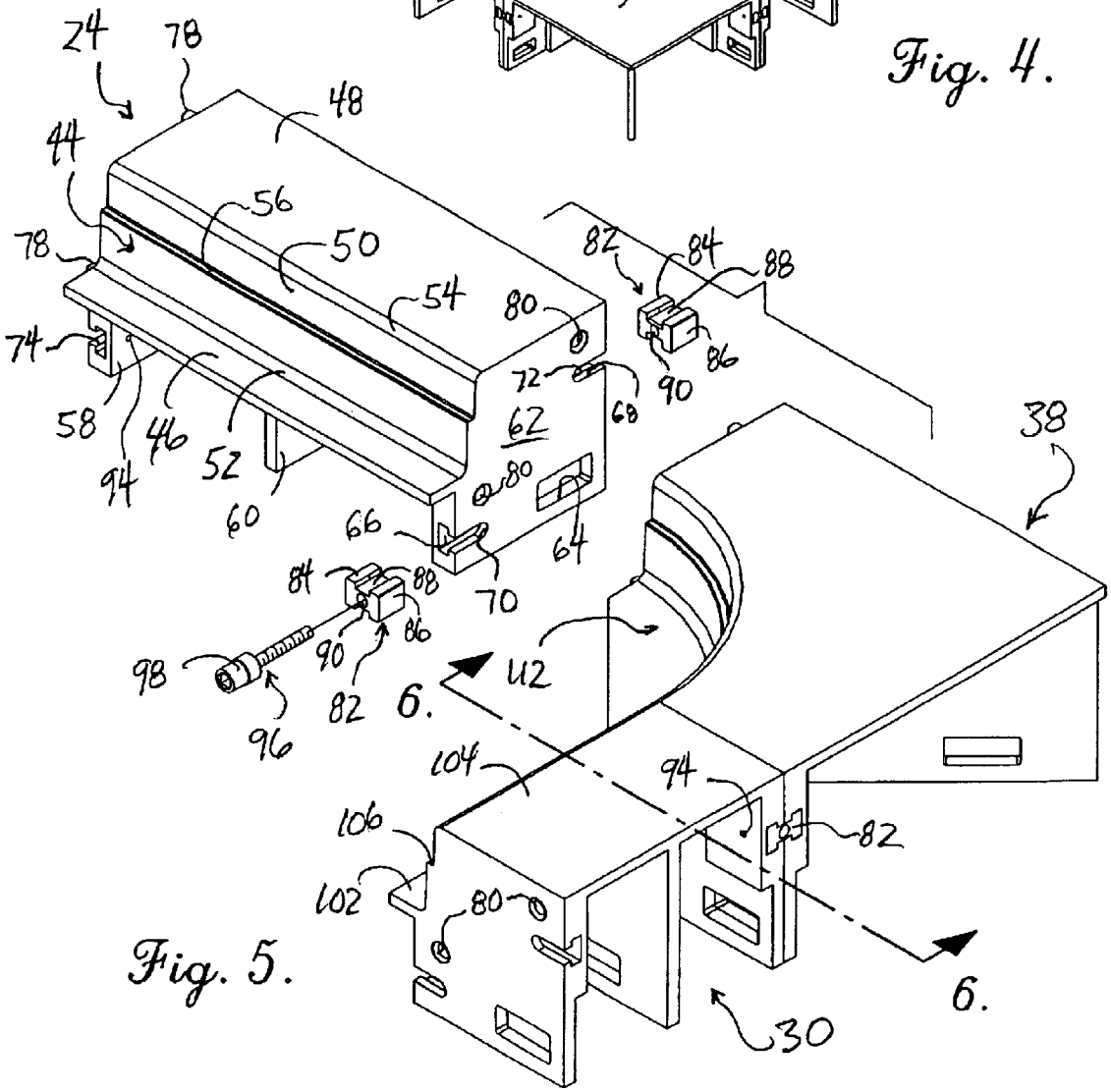
FIG. 5 is an enlarged and exploded perspective view of a span member, a corner member, and a rise member of the pallet illustrated in FIG. 4, particularly illustrating the alignment and orientation of a pair of keys for installation and removal of the keys from their respective keyways.
Figure 6:
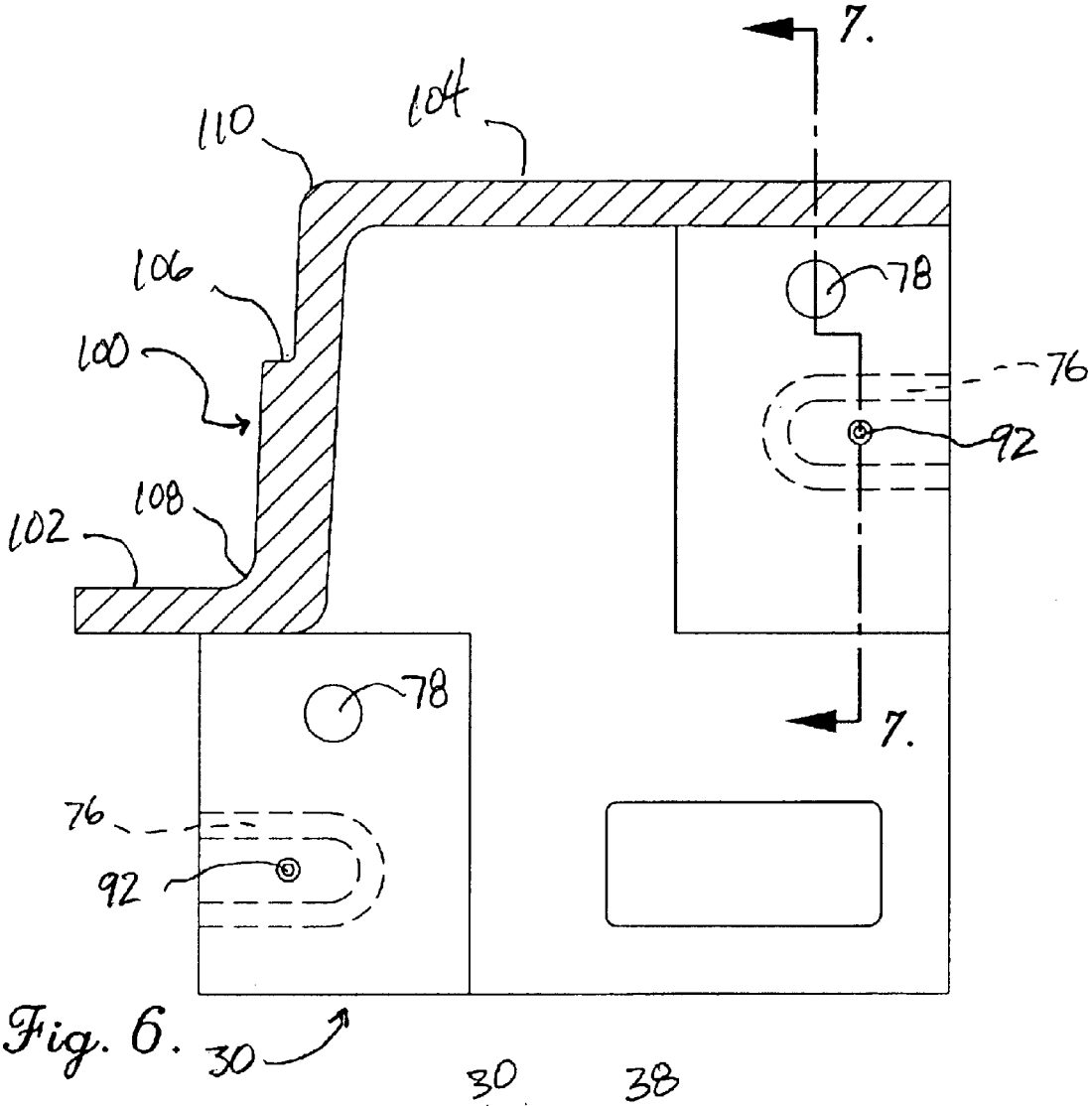
FIG. 6 is an enlarged sectional view of the rise member of the pallet taken substantially along line 6—6 of FIG. 5, particularly illustrating the channels in the rise member that form a portion of the keyways for receiving the keys to couple the rise and the corner members.

Particularly, each of the span segments 20,22,24,26 present a generally elongated forming surface for molding the span portion of the face $F_2$. As will be described in detail below, during assembly of the system 10, span segments can be added or removed as necessary to set the desired span dimension of the molded culvert. Each of the span segments 20,22,24,26 are virtually identical in construction and thus only the span segment 24 will be described in detail with the understanding that the span segments 20,22,26 are similarly configured. As shown in FIG. 5, the illustrated span segment 24 presents a generally S-shaped forming surface 44 including a pair of vertically spaced, generally-parallel horizontal facets 46 and 48 and a generally vertical, intermediate facet 50 extending between the facets 46, 48. For purposes that will subsequently be described, the upper facet 48 presents a greater surface area relative to the lower facet 46. The facets 46 and 50 are joined by a chamfered valley 52. The facets 48 and 50 are joined by a chamfered crest 54. The intermediate facet 50 is generally transverse to the facets 46, 48 and includes a horizontally extending rib 56. The chamfered valley 52 and crest 54 and the ribbed intermediate facet 50 cooperate to provide a configuration that enables sealer feasibility when joining the finished culverts. It is within the ambit of the present invention to utilize various alternative configurations for the forming surface of the pallet span segments depending on the particular application. However, the forming surface configuration of the span segments preferably generally match the rise and corner segments and complement the configuration of the forming surface of the header span segments (as described in detail below) to enable joining the finished culverts together face-to-face in a sealing relationship.

The forming surface 44 of the pallet span segment 24 is supported by generally vertically extending legs 58, 60, and 62 horizontally spaced from one another. To provide a strong and secure configuration, the illustrated span segment 24 is preferably formed by casting and/or machining the segment from a single billet of metal (e.g., cast from an iron alloy such as steel, etc.). In this regard, each of the legs 58, 60, 62 includes a clamping slot (only the clamping slot 64 on the leg 62 being shown) to facilitate manufacturing.

As previously indicated, the pallet span segments 20,22, 24,26 are removably couplable to adjacent pallet segments (e.g., the span segment 24 is couplable to the span segment 26 and the corner segment 38). In the illustrated pallet 12, the segments are couplable by a mechanism of keys and complemental keyways. In this manner, the segments are relatively easily and efficiently coupled to provide a secure and strong pallet. In more detail, formed in the leg 62 of the pallet span segment 24 is a lower key-receiving channel 66 and an upper key-receiving channel 68 (see FIG. 5). The lower channel 66 opens to the front of the leg 62 and is spaced below the lower horizontal facet 46. The upper channel 68 opens to the back of the leg 62 and is spaced below the upper horizontal facet 48. Each of the channels 66, 68 extends generally parallel to the corresponding adjacent facet 46, 48 and extends partially into the leg 62 toward the center thereof to define a corresponding backstop 70 and 72, respectively. As will be described in further detail below with respect to similarly configured channels, each of the channels 66,68 is generally T-shaped in vertical cross-section and is open toward the outside of the leg 62 so as to define a tract into which a portion of a key may be inserted.

The opposite leg 58 of the span segment 24 includes a pair of channels (with only the lower channel 74 being shown) similarly configured and positioned. It will be appreciated that the lower channel 74 and the upper channel in the leg 58 are complemental mirror images of the channels 66, 68, respectively. In a similar manner, all of the pallet segments 20,22,24,26,28,30,32,34,36,38,40,42 include similarly configured and positioned "mirrored" channels on their opposing ends. In this regard, when any two adjacent pallet segments are properly positioned end-to-end, the corresponding mirrored channels cooperate to define pallet keyways 76 (see FIGS. 7 and 8).

To facilitate the proper alignment with adjacent pallet segments, each segment includes an alignment mechanism. Particularly, in the illustrated pallet 12, the alignment mechanism includes alignment pins 78 extending out from the outside of one end of the pallet segment above each of the corresponding channels and complemental alignment pin-receiving apertures 80 formed in the opposite end of the pallet segment above each of the corresponding channels. For example, the leg 58 of the pallet span segment 24 includes a pair of alignment pins 78, one positioned above each of the lower channel 74 and the upper channel. The leg 62 of the span segment 24 includes a complemental pair of pin-receiving apertures 80, one positioned above each of the channels 66,68 (see FIG. 5). Each of the pins 78 is tapered at its end and each of the apertures 80 is tapered at its opening to facilitate a quick and easy mating of the pins 78 into the apertures 80 (see FIG. 7).

As shown in FIGS. 5–8, and as previously indicated, when two adjacent pallet segments are properly positioned end-to-end, the pallet keyways 76 are defined by the complemental mirrored channels. Each of the keyways 76 is configured to receive one of a plurality of keys 82 for removably coupling the adjacent segments together. Particularly, each of the illustrated keys 82 presents a generally I-shaped vertical cross-section and includes opposing wedge sections 84 and 86 separated by a bridge section 88 (see FIGS. 5 and 7). Each of the wedge sections 84,86 are sized and dimensioned to cooperate with a portion of the bridge section 88 to slide within a respective one of the T-shaped mirrored channels (e.g., the channels 66 and 74). The bridge section 88 is configured to space the wedge sections 84,86 so that when one of the keys 82 is slidably inserted into one of the keyways 76, the wedge sections 84,86 pull the adjacent pallet segments together and securely retain them in this joined relationship (see FIG. 7). For purposes that will subsequently be described, formed in each of the bridge sections 88 is a threaded shank-receiving aperture 90. To facilitate the tightening and securing functions of the keys 82, the wedge sections 84,86 and the mirrored channels of the keyways 76 are preferably tapered (see FIG. 7). In this manner, the keys 82 can be manipulated further into the keyways 76 to further tighten and secure the adjacent segments together (e.g., the keys 82 can be hammered into the keyways 76, etc.).

The system 10 preferably includes a mechanism for retaining the keys 82 in position in the keyways 76. In the illustrated system 10, once the key 82 is securely positioned into the keyway 76, the user can secure the key 82 in position with one or more of a plurality of setscrews 92. In more detail, each pallet segment includes threaded screw-receiving apertures 94 that communicate with the inside surface of the corresponding leg and the tract of the corresponding channel (see FIGS. 7 and 8). For example, the leg 58 of the pallet span segment 24 includes one of the apertures 94 extending between the inside surface of the leg 58 and the tract of both the lower channel 74 and the upper channel (with only the aperture 94 communicating with the channel 74 being shown in FIG. 5). The setscrews 92 are threadably received (e.g., having an allen-type head into which an allen-type wrench can be inserted to screw the screws 92 into the apertures 94) in the screw-receiving apertures 94 until they engage the corresponding wedge section 84,86 of the key 82 received in the keyway 76 to retain the key 82 therein. It is within the ambit of the present invention to utilize various alternative configurations to tighten and retain the keys in the keyways. For example, the keyways could be vertically inclined and tapered to facilitate retaining the keys therein without the need for additional securing mechanisms. However, if vertically inclined keyways are utilized, the inclination is preferably only partially vertical to facilitate preventing concrete from undesirably clogging the keyways and frustrating removal of the keys.

When it is desired to remove the keys 82 from the keyways 76, the illustrated keys 82 provide a quick and easy mechanism for removing the keys 82. Particularly, the illustrated system 10 includes one or more threaded shanks 96 (see FIGS. 5 and 8) that can be threaded into the shank-receiving apertures 90 to dislodge the keys 82 from the keyways 76. In more detail, the shanks 96 each include a socket-type head 98 configured for receiving a conventional socket driver therein for rotating the shank 96. The shank 96 is sized and dimensioned so that when it is threaded into the aperture 90 it can extend fully through the bridge section 88 and engage the backstops (e.g., the backstops 70, 72 of the channels 66,68 in the leg 62 of the span segment 24) to eject the key 82 from the keyway 76 (see FIG. 8). The illustrated shanks 96 are sufficiently dimensioned to facilitate the use of a prying tool (e.g., a drift, etc.) under the head 98 if necessary to further manipulate a tightly lodged key 82 from the keyway 76.

As previously indicated, each of the pallet span segments 20,22,24,26 is removably couplable to each of the other span segments and to each of the pallet rise segments 28,30,32,34 and each of the pallet corner segments 36,38,40,42 to form the desired shaped and dimensioned pallet 12. Accordingly, as detailed above, each of the rise segments 28,30,32,34 and each of the corner segments 35, 38, 40, 42 include complemental mirrored channels formed in their opposite ends so as to define the keyways 76 for receiving the keys 82 when properly positioned end-to-end with an adjacent pallet segment. It is therefore important that each of the rise segments 28,30,32,34 and each of the corner segments 36,38,40,42 includes a forming surface that generally matches the previously described forming surface 44 of the span segment 24 so that the assembled pallet 12 is operable to form a generally uniform face $F_2$ for the culverts $C_1$ and $C_2$.

In this regard, each of the pallet rise segments 28,30,32,34 includes a forming surface 100 substantially similar to the configuration described above with respect to the forming surface 44. Particularly, each of the forming surfaces 100 includes generally elongated lower and upper horizontal facets 102 and 104, respectively (see FIG. 6). However, in the illustrated pallet 12, the rise segments 28,30,32,34 are relatively shorter than the span segments 20,22,24,26 to facilitate the forming of the desired dimensioned culverts $C_1$ and $C_2$. The facets 102,104 are spaced apart and extend generally parallel to one another. The facets 102,104 are connected by a generally transverse intermediate ribbed facet 106. The facets 102 and 106 are joined by a chamfered valley 108 and the facets 104 and 106 are joined by a chamfered ridge 110. Additionally, each of the forming surfaces 100 is supported by vertical legs, similar to the previously described legs 58,60,62, that support the forming surface 100 at substantially the same height as the forming surface 44.

In a similar manner, each of the pallet corner segments 36,38,40,42 includes a forming surface 112 similar to the configuration of the above described forming surfaces 44 and 100. However, unlike the surfaces 44 and 100, each of the forming surfaces 112 extends arcuately, defining a generally ninety-degree bend from end-to-end (see FIG. 5). Each of the forming surfaces 112 includes the generally S-shaped configuration including the lower and upper horizontal facets spanned by the vertical intermediate ribbed facet and joined thereto using a chamfered valley and ridge. As shown in FIG. 5, the upper horizontal facet of each of the surfaces 112 extends from the arcuate ridge to define a ninety-degree corner for forming the outer corners of the culverts $C_1$ and $C_2$. The lower horizontal facet of each of the surfaces 112 is arcuately configured along the valley, however, the edge opposite the valley extends generally linearly between the ends of the surface 112 (see FIG. 4). Each of the surfaces 112 is supported by spaced apart vertical legs that support the respective surface 112 at substantially the same height as the forming surfaces 44 and 100.

Figure 4:
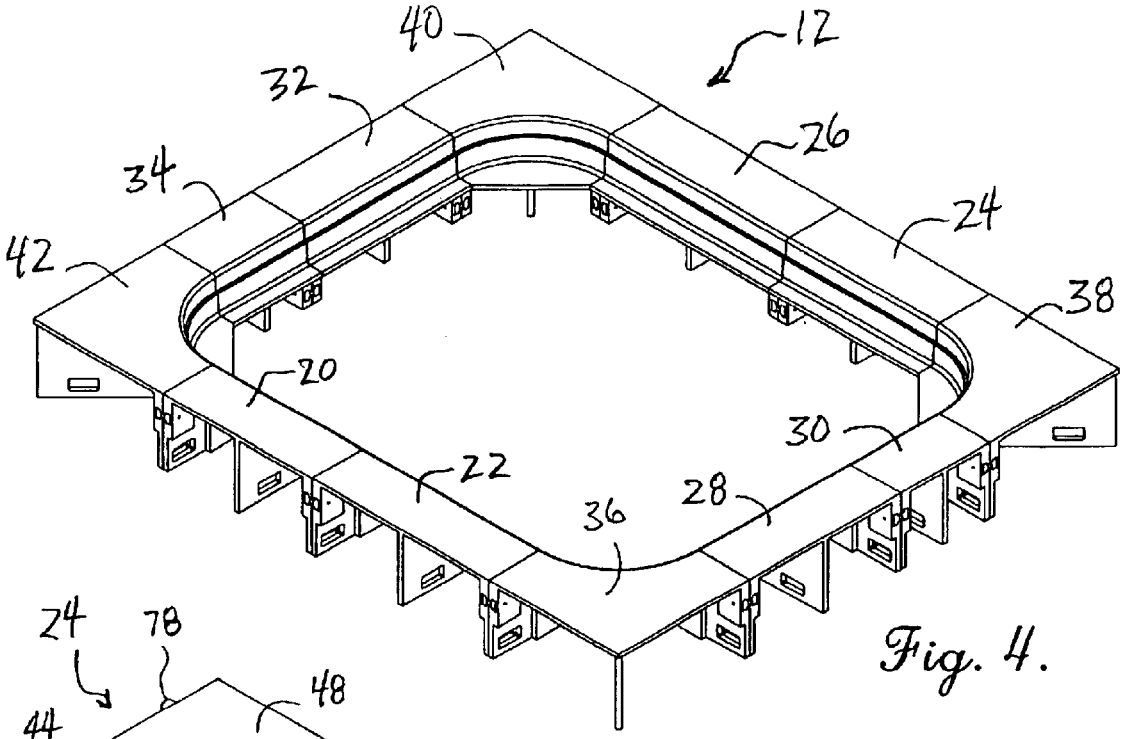
FIG. 4 is a perspective view of the pallet of the system illustrated in FIG. 1.
Figure 7:
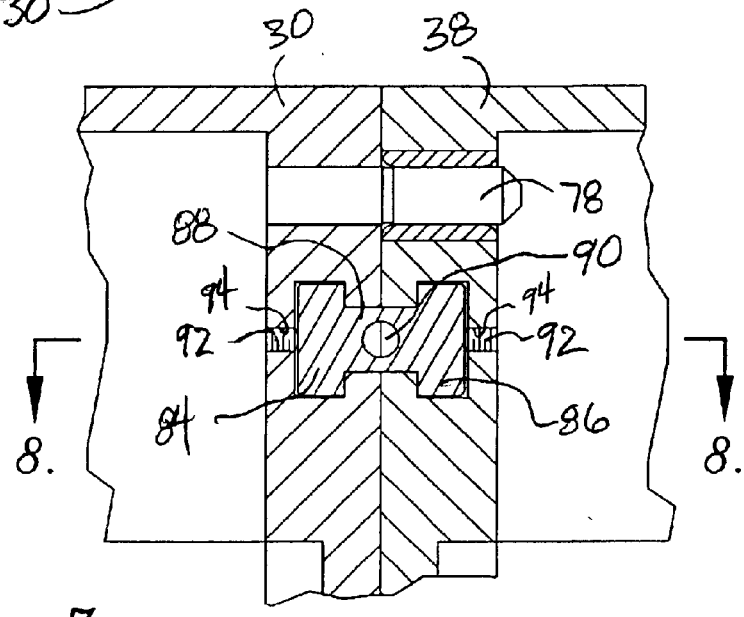
FIG. 7 is an enlarged sectional view of the rise and corner members of the pallet taken substantially along line 7—7 of FIG. 6, particularly illustrating one of the keys received in the keyway.

As illustrated in FIG. 4, the pallet span segments 20,22, 24,26, the pallet rise segments 28,30,32,34, and the pallet corner segments 36,38,40,42 are removably coupled together as shown to form the illustrated pallet 12. Particularly, the segments are positioned end-to-end so that the alignment pins 78 are matingly received within the pin-receiving apertures 80 as shown in FIG. 7. The keys 82 are then slidably inserted into the pallet keyways 76 and manipulated into the keyways 76 until the adjacent segments are securely retained together. The setscrews 92 are then tightened against the corresponding wedge sections 84,86 to retain the keys 82 in position (see FIG. 8). The span segments 20,22,24,26 and the rise segments 28,30,32,34 are preferably dimensioned to correspond with popular industry desired span and rise dimensions for the box culverts $C_1$ and $C_2$ (e.g., dimensions corresponding to C-789 culverts, C-850 culverts, etc.). In this regard, the illustrated span and rise segments are sized and dimensioned so that the pallet 12 can be converted between industry desired dimensions by simply adding or removing a span segment and a rise segment from each side of the pallet 12. It is, however, within the ambit of the present invention to utilize various alternative configurations for the modular segments that form the pallet. For example, L-shaped segments could be used as opposed to the individual span, rise, and corner segments. If L-shaped segments are utilized, extension or spacer members could be utilized in combination with the L-shaped segments to adjust the span and rise dimensions as desired.

Returning to FIG. 1, the core 14 is engagingly received within the pallet 12 so that the lower horizontal facets of the pallet segments engage and encircle the core 14. The core 14 is operable to mold the inner circumferential surface of the box culvert (e.g., the surface ICS of the culvert $C_1$). In one manner known in the art, the illustrated core 14 is an adjustable core including a plurality of prefabricated core components 114 and a plurality of prefabricated core extensions 116 that removably couple together (e.g., bolted together, etc.). In more detail, the illustrated core 14 includes four core components 114, each being a ninety-degree corner that presents an outer surface 118 that generally matches the shape of the edge of the lower horizontal facets of the pallet corner segments 28,30,32,34. Removably coupled to the components 114 are four core extensions 116 that are sized and dimensioned to complement the dimensions of the pallet 12. The illustrated extensions 116 are bolted to the components 114. In this manner, the core 14 is adjustable in a manner compatible with the adjustability of the pallet 12. Each of the components 114 and extensions 116 of the core 14 includes a lip 120 positioned toward the bottom of the corresponding component or extension. The lip 120 is configured to engage the underside of the lower horizontal facets of the segments of the pallet 12 to stabilize the core 14 during formation of the box culverts and prevent it from undesirably shifting while the concrete sets. Each of the components 114 and extensions 116 of the core 14 further includes an angled top section 122 to facilitate pouring the concrete and preventing it from entering the center of the core 14. It is within the ambit of the present invention to utilize a core cap (not shown) that couples to the core 14 to prevent concrete from entering the center of the core 14.

As illustrated in FIG. 1, and as previously indicated, the jacket 16 is supported on the pallet 12 and is operable to mold the outside circumferential surface of the box culvert (e.g., the surface OCS of the culvert $C_1$). In one manner known in the art, the illustrated jacket 16, similar to the previously described core 14, is an adjustable jacket including a plurality of prefabricated jacket components 124 and a plurality of prefabricated jacket extensions 126 that removably couple together (e.g., bolted together, etc.). In more detail, the illustrated jacket 16 includes four jacket components 124 (only three of which are shown) each presenting a ninety-degree corner. Removably coupled to the components 124 are four jacket extensions 126 that are sized and dimensioned to complement the dimensions of the pallet 12 and the core 14. For purposes that will subsequently be described, the components 124 and extensions 126 are dimensioned such that the assembled jacket 16 encircles the core 14 and is spaced therefrom to define an annular recess therebetween. The illustrated extensions 126 are bolted to the components 124. In this manner, the jacket 16 is adjustable in a manner compatible with the adjustability of the pallet 12 and the core 14. Each of the components 124 and extensions 126 includes a notched bottom surface 128 configured to engage the outside edge of the upper horizontal facets (e.g., along the surface area thereof in excess of the surface area of the lower horizontal facet) of the segments of the pallet 12 to facilitate setting the spacing between the core 14 and the jacket 16 and to stabilize the jacket 16 on the pallet 12. Additionally, for purposes that will subsequently be described, each of the components 124 and extensions 126 define a ledge positioned toward the top thereof. The jacket 16 may be secured to the pallet 12, for example with a series of clamps (not shown) during forming of the box culverts.

The jacket 16 cooperates with the pallet 12 and the core 14 to form the annular recess into which the concrete is poured. In this regard, the jacket 16 preferably includes a series of vibrators 130 for vibrating the jacket 16 and/or the core 14 while the concrete is loaded into the forming system 10. The vibrators 130 can be any suitable vibration mechanism known in the art (e.g., an eccentric-type motor, etc.). Additionally, as is known in the art, the jacket 16 preferably includes a plurality of lift holes (not shown) formed through the components 124 or extensions 126 and corresponding lift hole pins (not shown) for inserting through the lift holes to form a means of lifting the finished culverts. The components and extensions of the core 14 and jacket 16 are preferably prefabricated from sheet steel and reinforced as necessary. However, it is within the ambit of the present invention to utilize any suitable alternative configuration for the core and jacket. For example, the core and jacket could be machined out of a cast metal billet. Additionally, the jacket could include structure for allowing the concrete to be injected into the annular recess from the bottom of the forming system rather than poured in from the top. Furthermore, the components and extensions could be keyed together in a manner similar to the pallet 12 described above. As with the keys 82 and keyways 76 described above, utilizing keys to couple the modular sections of the core and the jacket is desirable because it is believed such a configuration significantly reduces the loosening of the sections during vibration of the system (e.g., the bolts may undesirably loosen during such vibration).

Figure 2:
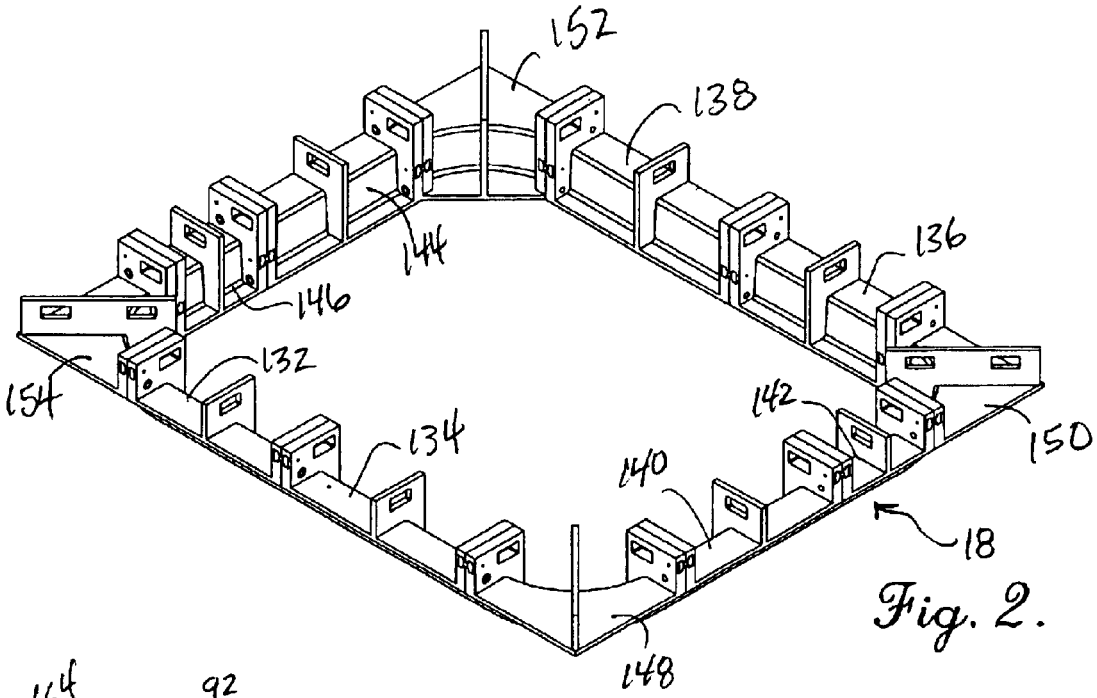
FIG. 2 is a perspective view of the header of the system illustrated in FIG. 1.
Figure 3:
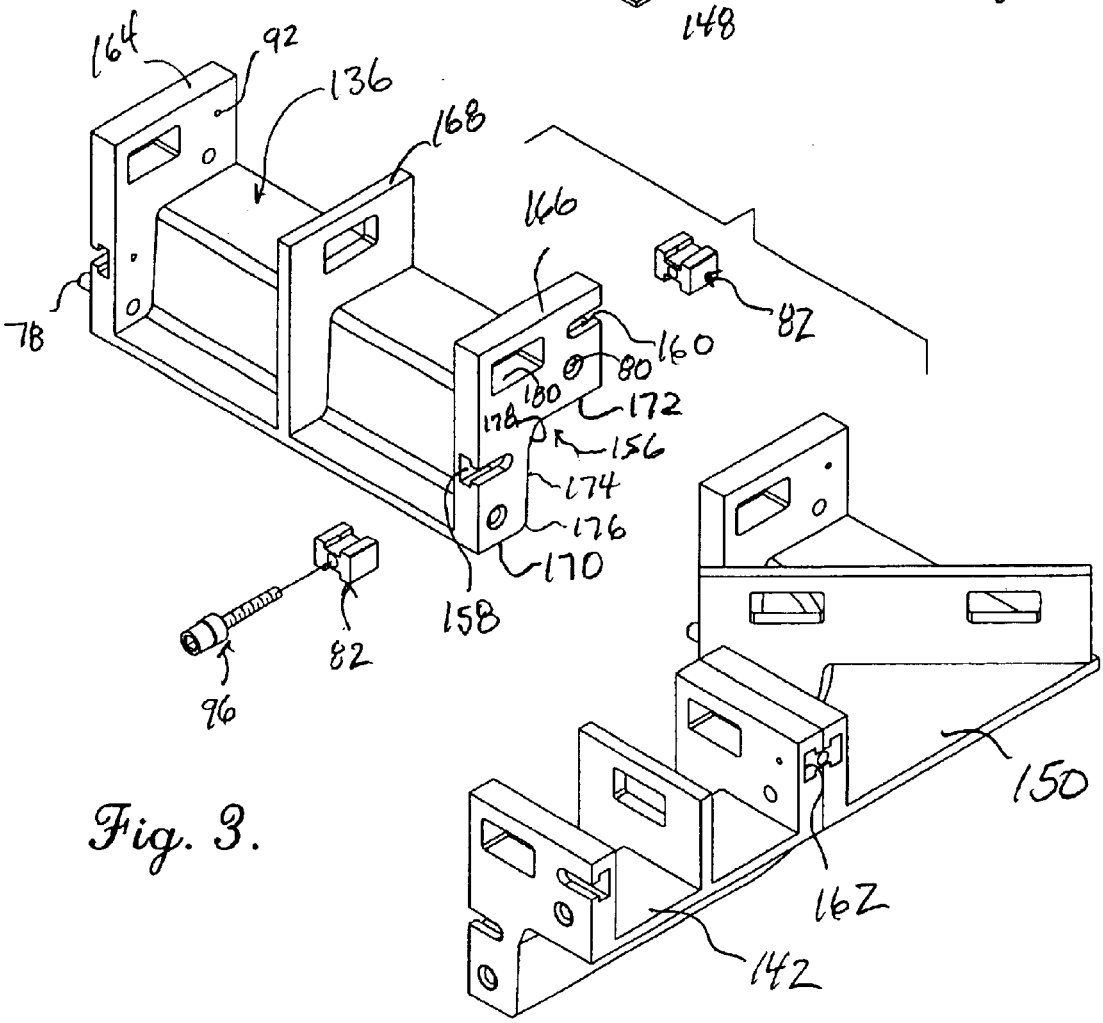
FIG. 3 is an enlarged and exploded perspective assembly view of a span member, a corner member, and a rise member of the header illustrated in FIG. 2, particularly illustrating the alignment and orientation of a pair of keys for installation and removal of the keys from their respective keyways.

Turning to FIGS. 1–3, the header 18 encircles the core 14 and is operable to slide between the core 14 and the jacket 16 to mold the non-ribbed face $F_1$ of the culvert $C_1$. The illustrated header 18, similar to the previously described pallet 12, is modular and includes a plurality of header span segments 132, 134, 136, and 138, a plurality of header rise segments 140, 142, 144, and 146, and a plurality of header corner segments 148, 150, 152, and 154. Additionally, each of the header segments presents a similar forming surface 156 and is removably and securely couplable to two adjacent segments in the same manner as detailed above with respect to the pallet 12. Particularly, each header segment includes lower and upper key-receiving channels 158 and 160, respectively, that cooperate when adjacent header segments are properly positioned end-to-end to define header keyways 162 that slidably receive the keys 82. Similarly, each of the header segments further includes the alignment pins 78 and the alignment pin-receiving apertures 80 to facilitate the proper positioning of adjacent header segments. In this manner, the header segments cooperate to define the enclosed header 18.

However, unlike the previously described segments of the pallet 12, for purposes that will subsequently be described, the forming surface 156 presented by each of the segments of the header 18 is defined on the bottom surface of the corresponding segment. Therefore, instead of the vertical legs included in each pallet segment, each header segment includes a plurality of trusses formed above the forming surface 156. The lower and upper channels 158,160 and the pins 78 and apertures 80 are defined in these trusses. In more detail with respect to the header span segment 136, a pair of opposite spaced apart end trusses 164 and 166 and an intermediate truss 168 therebetween are defined above the forming surface 156. Each end truss 164,166 includes one of the mirrored lower channels 158 and one of the mirrored upper channels 160 (see FIG. 3). As with the channels 66,68 described above with respect to the pallet span segment 24, each of the channels 158,160 include corresponding setscrew-receiving apertures 94 that threadably receive the setscrews 92 for securing the keys 82 in the header keyways 162. The truss 164 includes a pair of the pins 78 and the truss 166 includes a corresponding pair of the apertures 80.

As previously indicated, the header 18 slides in the annular recess defined between the core 14 and the jacket 16 to form the non-ribbed face $F_1$ of the box culverts $C_1$ and $C_2$. In this regard, the forming surface 156 of each of the header segments is sized and dimensioned to "float" on top of the concrete received in the annular recess, stripping it off the core 14 and the jacket 16, and pressing it into the finished culverts $C_1$ and $C_2$. Particularly, each forming surface 156 includes lower horizontal facet 170, an upper horizontal facet 172, and an intermediate generally transverse vertical facet 174 (see FIG. 3). The facets 170 and 174 are joined by a chamfered ridge 176 and the facets 172 and 174 are joined by a chamfered valley 178. The facets 170,172,174 are configured to generally complement the previously described facets 102,104,106 of the segments of the pallet 12 so that the finished faces F1 and F2 formed thereby, respectively, can be joined together (see FIGS. 9 and 10). It will be appreciated that each of the forming surfaces 156 of the other segments of the header 18 are similarly configured. However, the forming surface 156 of each of the header corner segments 148,150,152,154, similar to the pallet corner segments 36,38,40,42 previously described, includes an arcuate extending valley 178 as opposed to a generally linearly extending valley 178. To set the desired dimensions of the finished culverts $C_1$ and $C_2$, each of the segments of the header 18 is configured to seat on the ledge formed in the components 124 and extensions 126 of the jacket 16 (see FIG. 1).

Just as with the segments of the pallet 12 described above, the illustrated segments of the header 18 are preferably formed from a single billet of metal (e.g., cast from an iron alloy such as steel, etc.). In this regard, each of the trusses 164,166,168 includes a clamping slot 180 to facilitate manufacturing. This preferred construction provides a strong and relatively heavy header 18 that is self-seating, i.e., one that enables forming the finished culverts $C_1$ and $C_2$ without the need for an additional dead weight such as a header frame. However, it is within the ambit of the present invention to utilize such a header frame.

In operation, the core components 114 and the core extensions 116 are bolted together to set the desired dimensions of the forming surface for forming the inner-circumferential surface ICS of the culverts $C_1$ and $C_2$. The segments of the pallet 12 are then assembled by inserting the keys 82 into the pallet keyways 76 and tightening the setscrews 92. The pallet 12 is assembled with the necessary span and rise segments to match the dimensions of the outer surface 118 of the assembled core 14. Each of the segments of the pallet 12 engage the outer surface 118 and the lip 120 of the core 14. Next, the jacket components 124 and jacket extensions 126 are bolted together so that the assembled jacket 16 generally matches the dimensions of the pallet 12. The notched bottom surface 128 of the jacket 16 should engage and rest upon the upper horizontal facets 104 of the segments of the pallet 12. If desired, the jacket 16 may be clamped to the pallet 12. The segments of the header 18 are then assembled by inserting the keys 82 into the header keyways 162 and tightening the setscrews 92. The header 18 is assembled with the necessary span and rise segments to match the dimensions of the annular recess defined between the core 14 and the jacket 16. Next, concrete is poured into the annular recess to the desired level. The header 18 is then slid between the core 14 and the jacket 16. The vibrators 130 and lift-hole pins can then be implemented as desired. Once the concrete sets, the system 10 can be disassembled by unbolting the core 14 and jacket 16 and by threading the shanks 96 into the apertures 94 to remove the keys 82 to access the finished box culvert.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby state his intent to rely on the Doctrine of Equivalents to determine and assess the reasonably fair scope of the present invention as pertains to any apparatus not materially departing from but outside the literal scope of the invention as set forth in the following claims.

What is claimed is:

1. A header for use with a pallet, a jacket supported on the pallet, and a core encircled by the jacket to define a form for forming concrete received therebetween into box culverts having opposite faces, the header comprising:

a plurality of members removably couplable to one another so that when the members are coupled together they are operable to encircle the core and slide between the core and the jacket to contact concrete received therebetween to form one of the faces of the box culvert, each member including at least one channel defined therein being sized and dimensioned to cooperate with the channel in an adjacent member to define a keyway; and a key being sized and dimensioned to be slidably received in the keyway to thereby removably couple the adjacent members.

2. The header as claimed in claim 1, each of the members being formed from a single metal billet of sufficient weight so that when the members are coupled together, the header is self-seating.

3. The header as claimed in claim 2, said billet being cast out of a metal including at least a portion of iron.

4. The header as claimed in claim 1, each of said channels being generally horizontal when the members are coupled together.

5. The header as claimed in claim 1, said plurality of members including at least one span member presenting an elongated forming surface extending between the core and the jacket, said forming surface including a lower facet, an upper facet, and a transverse facet extending between the upper and lower facets.

6. The header as claimed in claim 5, said lower and transverse facets being joined by a chamfered ridge, said upper and transverse facets being joined by a chamfered valley.

7. The header as claimed in claim 6, said span member further including opposite side walls spaced apart on either side of the forming surface and extending upwardly therefrom.

8. The header as claimed in claim 7, each side wall presenting a first and a second channel defined therein, one of said first or second channels being said at least one channel.

9. The header as claimed in claim 8, said first channel being spaced upwardly from the lower facet and extending generally parallel thereto, said second channel being spaced upwardly from the upper facet and extending generally parallel thereto.

10. The header as claimed in claim 9, each of said channels presenting a generally T-shaped cross section.

11. The header as claimed in claim 10, said span member including at least one screw-receiving aperture in communication with one of the channels and a set screw threadably received in the aperture and operable to engage the key received in the corresponding channel to thereby selectively prevent removal of the key from the channel.

12. The header as claimed in claim 11, at least one of said side walls including a pin-receiving aperture operable to receive an alignment pin when coupled together with an adjacent member.

13. The header as claimed in claim 5, said plurality of members further including at least one corner member presenting an arcuate forming surface extending between the core and the jacket, said forming surface including a lower facet, and upper facet, and a transverse facet extending between the upper and lower facets.

14. The header as claimed in claim 13, said at least one corner member being removably couplable to either end of said at least one span member.

15. The header as claimed in claim 1, said key including a generally I-shaped cross section.

16. The header as claimed in claim 15, said key including a shank-receiving aperture extending through the key to communicate with opposed surfaces thereof.

17. The header as claimed in claim 16, said key including a shank removably insertable into the shank-receiving aperture so that when the shank is inserted therein, the key is caused to slide relative to the keyway it is received in.

18. A pallet for use with a core, a jacket encircling the core, and a header slidable between the core and the jacket to define a form for forming concrete received therebetween into box culverts having opposite faces, the pallet comprising:

a plurality of members removably couplable to one another so that when the members are coupled together they are operable to encircle the core and support the jacket to contact concrete received therebetween to form one of the faces of the box culvert, each member including at least one channel defined therein being sized and dimensioned to cooperate with the channel in an adjacent member to define a keyway; and a key being sized and dimensioned to be slidably received in the keyway to thereby removably couple the adjacent members.

19. The pallet as claimed in claim 18, each of the members being cast out of a metal billet.

20. The pallet as claimed in claim 19, said billet being formed from a metal including iron.

21. The pallet as claimed in claim 18, each of said channels being generally horizontal when the members are coupled together.

22. The pallet as claimed in claim 18, said plurality of members including at least one span member presenting an elongated forming surface extending between the core and the jacket, said forming surface including a lower facet, an upper facet, and a transverse facet extending between the upper and lower facets.

23. The pallet as claimed in claim 22, said lower and transverse facets being joined by a chamfered valley, said upper and transverse facets being joined by a chamfered ridge.

24. The pallet as claimed in claim 22, said span member further including opposite side walls spaced apart on either side of the forming surface and extending downwardly therefrom.

25. The pallet as claimed in claim 24, each side wall presenting a first and a second channel defined therein, one of said first or second channels being said at least one channel.

26. The pallet as claimed in claim 25, said first channel being spaced downwardly from the lower facet and extending generally parallel thereto, said second channel being spaced downwardly from the upper facet and extending generally parallel thereto.

27. The pallet as claimed in claim 26, each of said channels presenting a generally T-shaped cross section.

28. The pallet as claimed in claim 27, said span member including at least one screw-receiving aperture in communication with one of the channels and a set screw threadably received in the aperture and operable to engage the key received in the corresponding channel to thereby selectively prevent removal of the key from the channel.

29. The pallet as claimed in claim 28, at least one of said side walls including a pin-receiving aperture operable to receive an alignment pin when coupled together with an adjacent member.

30. The pallet as claimed in claim 22, said plurality of members further including at least one corner member presenting an arcuate forming surface extending between the core and the jacket, said forming surface including a lower facet, and upper facet, and a transverse facet extending between the upper and lower facets.

31. The pallet as claimed in claim 30, said at least one corner member being removably couplable to either end of said at least one span member.

32. The pallet as claimed in claim 18, said key including a generally I-shaped cross section.

33. The pallet as claimed in claim 32, said key including a shank-receiving aperture extending through the key to communicate with opposed surfaces thereof.

34. The pallet as claimed in claim 33, said key including a shank removably insertable into the shank-receiving aperture so that when the shank is inserted therein, the key is caused to slide relative to the keyway it is received in.

35. A modular forming system for forming concrete into a box culvert having opposite faces, the system comprising:

a core operable to mold the inside circumferential surface of the culvert;

a pallet encircling the core and being operable to mold one of the faces of the culvert;

a jacket supported on the pallet and spaced from the core and being operable to mold the outside circumferential surface of the culvert;

a header encircling the core and being operable to slide between the core and the jacket and being operable to mold the other face of the culvert, said pallet including a plurality of pallet members removably couplable to one another so that when the pallet members are coupled together they are operable to encircle the core to contact concrete received therebetween to form the one of the faces of the box culvert, each pallet member including at least one pallet channel defined therein being sized and dimensioned to cooperate with the pallet channel in an adjacent pallet member to define a pallet keyway, said header including a plurality of header members removably couplable to one another so that when the header members are coupled together they are operable to encircle the core and slide between the core and the jacket to contact concrete received therebetween to form the other face of the box culvert, each header member including at least one header channel defined therein being sized and dimensioned to cooperate with the header channel in an adjacent header member to define a header keyway; and a plurality of keys, each being sized and dimensioned to be slidably received in the pallet and header keyways to thereby removably couple the respective adjacent members.

36. The modular forming system as claimed in claim 35, each of the header members being formed from a single metal billet of sufficient weight so that when the members are coupled together, the header is self-seating.

37. The modular forming system as claimed in claim 36, said billet being cast out of a metal including at least a portion of iron.

38. The modular forming system as claimed in claim 36, each of said pallet members being formed from a single metal billet.

39. The modular forming system as claimed in claim 38, said billets being cast out of a metal including at least a portion of iron.

40. The modular forming system as claimed in claim 35, each of said pallet and header channels being generally horizontal when the corresponding pallet and header members are coupled to adjacent pallet and header members, respectively.

41. The modular forming system as claimed in claim 40, each of said pallet and header channels presenting a generally T-shaped cross section.

42. The modular forming system as claimed in claim 40, each of said pallet and header channels including at least one screw-receiving aperture and a set screw threadably received therein and operable to engage the key received in the corresponding channel to thereby selectively prevent removal of the key from the channel.

43. The modular forming system as claimed in claim 35, each of said keys presenting a generally I-shaped cross section.

44. The modular forming system as claimed in claim 35, each of said keys including a shank-receiving aperture extending through the key to communicate with opposed surfaces thereof.

45. The modular forming system as claimed in claim 44, each of said keys further including a shank removably insertable into the shank-receiving aperture so that when the shank is inserted therein, the key is caused to slide relative to the keyway it is received in.

* * * * *